US008783853B2

(12) United States Patent
Inoue et al.

(10) Patent No.: US 8,783,853 B2
(45) Date of Patent: Jul. 22, 2014

(54) LAYER FORMING DEVICE, IMAGE FORMING APPARATUS, AND COMPUTER READABLE MEDIUM

(75) Inventors: Hiroshi Inoue, Kanagawa (JP); Hiroshi Ikeda, Kanagawa (JP); Toshitake Yui, Kanagawa (JP); Kentaro Ageishi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 302 days.

(21) Appl. No.: 13/097,786

(22) Filed: Apr. 29, 2011

(65) Prior Publication Data

US 2012/0105541 A1 May 3, 2012

(30) Foreign Application Priority Data

Nov. 1, 2010 (JP) ..... 2010-245345

(51) Int. Cl.
*B41J 2/01* (2006.01)

(52) U.S. Cl.
USPC ..... 347/103; 347/101; 347/102; 347/105

(58) Field of Classification Search
USPC ..... 347/101–103, 105
See application file for complete search history.

(56) References Cited

U.S. PATENT DOCUMENTS

| | | | | |
|---|---|---|---|---|
| 6,595,619 | B2 * | 7/2003 | Barinaga et al. | 347/32 |
| 7,887,981 | B2 * | 2/2011 | Inagaki et al. | 430/66 |
| 7,951,516 | B2 * | 5/2011 | Inagaki et al. | 430/59.6 |
| 8,215,762 | B2 * | 7/2012 | Ageishi | 347/103 |
| 8,287,117 | B2 * | 10/2012 | Ageishi | 347/102 |
| 2006/0284951 | A1 | 12/2006 | Ikeda et al. | |
| 2008/0062241 | A1 | 3/2008 | Yamashita et al. | |
| 2009/0213201 | A1 | 8/2009 | Numata et al. | |
| 2010/0245510 | A1 | 9/2010 | Ageishi | |
| 2012/0064442 | A1 * | 3/2012 | Kawabata et al. | 430/56 |

FOREIGN PATENT DOCUMENTS

| | | |
|---|---|---|
| EP | 2 095 964 A1 | 9/2009 |
| JP | A-2008-68429 | 3/2008 |

OTHER PUBLICATIONS

European Search Report dated Jan. 20, 2012 issued in European Patent Application No. 11166577.4.

* cited by examiner

*Primary Examiner* — Justin Seo
(74) *Attorney, Agent, or Firm* — Oliff PLC

(57) ABSTRACT

A layer forming device forms a layer of liquid absorbing particles on a surface of a layer of a hardenable solution capable of being hardened in response to a given stimulus so that the liquid absorbing particles absorb liquid drops supplied to the surface of the layer of the hardenable solution.

3 Claims, 7 Drawing Sheets

LAYER FORMING DEVICE, IMAGE FORMING APPARATUS, AND COMPUTER READABLE MEDIUM

CROSS-REFERENCE TO RELATED APPLICATIONS

This application is based upon and claims priority under 35 USC 119 from Japanese Patent Application No. 2010-245345, filed Nov. 1, 2010.

BACKGROUND

Technical Field

The invention relates to a layer forming device, an image forming apparatus, and a computer readable medium.

SUMMARY OF THE INVENTION

According to an aspect of the invention, a layer forming device forms a layer of liquid absorbing particles on a surface of a layer of a hardenable solution capable of being hardened in response to a given stimulus so that the liquid absorbing particles absorb liquid drops supplied to the surface of the layer of the hardenable solution.

BRIEF DESCRIPTION OF THE DRAWINGS

Exemplary embodiments of the invention will be described in detail based on the following figures, wherein.

DETAILED DESCRIPTION

An example of an exemplary embodiment according to the invention will be described below with reference to the drawings.

[First Exemplary Embodiment]

Figure 1:
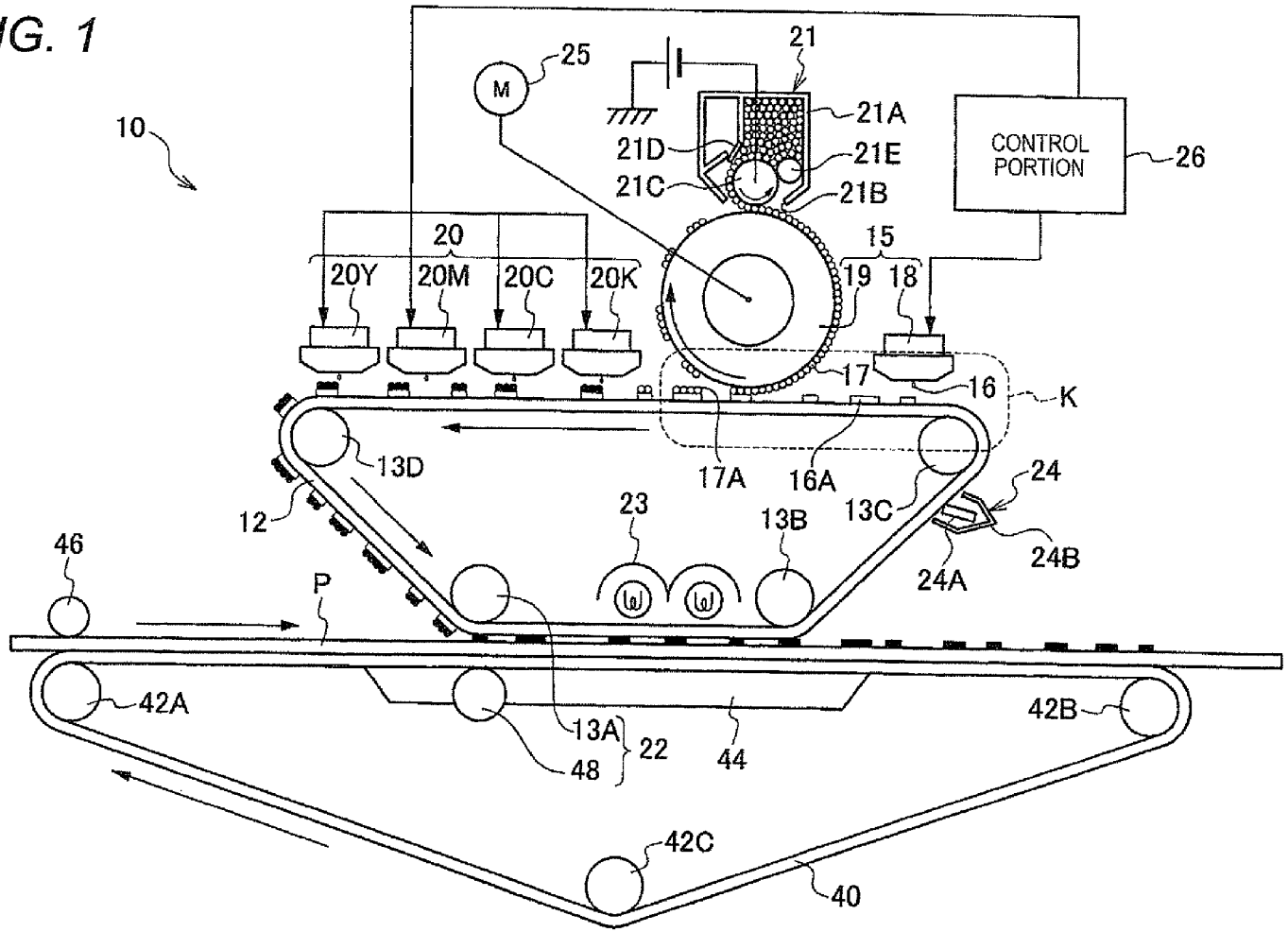
FIG. 1 is a schematic view showing the configuration of an image forming apparatus according to a first exemplary embodiment.

The configuration of an image forming apparatus 10 according to a first exemplary embodiment will be described first. FIG. 1 is a schematic view showing the configuration of the image forming apparatus 10 according to the first exemplary embodiment.

As shown in FIG. 1, the image forming apparatus 10 according to this exemplary embodiment has a transfer body 12 as an example of a to-be-formed body on which a layer of a hardenable solution (hereinafter referred to as hardenable solution layer) 16A which will be described later is formed, and a conveyance belt 40 which conveys a recording medium P as an example of a to-be-transferred body onto which the hardenable solution layer 16A formed on the transfer body 12 is transferred.

For example, a sheet of paper (specifically, plain paper, ink jet coated paper, art paper, etc.) or the like is used as the recording medium P onto which the hardenable solution layer 16A is transferred. Incidentally, the to-be-transferred body onto which the hardenable solution layer 16A is transferred is not limited thereto. For example, any material such as a film made of a resin or the like may be used as the to-be-transferred body as long as the hardenable solution layer 16A can be transferred onto the material.

The conveyance belt 40 is provided as an endless belt which is formed annularly and seamlessly. Incidentally, a seamed belt may be used as the conveyance belt 40.

Wrap and stretch rolls 42A, 42B and 42C as an example of wrapped and stretched members on which the conveyance belt 40 is wrapped and stretched are provided on an inner circumferential side of the conveyance belt 40. The wrap and stretch roll 42A is disposed on an upstream side (left in FIG. 1) in a direction of conveyance of the recording medium P in view from the transfer body 12. The wrap and stretch roll 42B is disposed on a downstream side (right in FIG. 1) in the direction of conveyance of the recording medium P in view from the wrap and stretch roll 42A and the transfer body 12. The wrap and stretch roll 42C is disposed on a side (lower in FIG. 1) opposite to the side on which the transfer body 12 is disposed, in view from a flat plate 44 which will be described later.

At least one of the wrap and stretch rolls 42A, 42B and 42C pushes the conveyance belt 40 toward its outer circumferential side to give tension to the conveyance belt 40. Configuration is made so that the conveyance belt 40 rotates (moves circularly) in one direction (clockwise in FIG. 1) when any one of the wrap and stretch rolls 42A, 42B and 42C is driven to rotate.

A pressing roll 46 which presses the recording medium P against a surface (outer circumferential surface) of the conveyance belt 40 is provided on an outer circumferential side (upper side in FIG. 1) of the conveyance belt 40 so as to be located in a position opposite to the wrap and stretch roll 42A with respect to the conveyance belt 40. The conveyance belt 40 is configured so that the recording medium P pressed by the pressing roll 46 is attached onto the surface of the conveyance belt 40 by electrostatic power or the like and the recording medium P is conveyed from a recording medium storage portion (not shown) where the recording medium P is stored, toward a recording medium discharge portion (not shown) where the recording medium P is discharged.

A flat plate (platen) 44 for flattening the recording medium P conveyed by the conveyance belt 40 is provided on an inner circumferential side of the conveyance belt 40. The flat plate 44 is disposed in a space between the wrap and stretch roll 42A and the wrap and stretch roll 42B so as to be located in a position (lower position than the transfer body 12 in FIG. 1) opposite to the transfer body 12 with respect to the conveyance belt 40. A pressure roll 48 which forms a part of a pressure member 22 which will be described later is provided in the flat plate 44.

Incidentally, the conveyance belt 40 is an example of a conveyance unit which conveys a to-be-transferred body, but the conveyance unit is not limited to the conveyance belt 40. For example, the conveyance unit for conveying a to-be-transferred body may be constituted by a pair of conveyance rolls which conveys the to-be-transferred body while putting the to-be-transferred body between the pair of conveyance rolls, or constituted by a conveyance drum which conveys the to-be-transferred body while depositing the to-be-transferred body on its outer circumferential surface. Any unit may be used as the conveyance unit as long as the unit can convey the to-be-transferred body.

Specifically, the transfer body 12 is made of a transfer belt formed annularly. The transfer belt may be a seamless endless belt or may be a seamed belt. The transfer body 12 has a width (axial length) equal to or larger than the width of the recording medium P.

Wrap and stretch rolls 13A, 13B, 13C and 13D as an example of wrap and stretch members on which the transfer body 12 is wrapped and stretched are provided on an inner circumferential side of the transfer body 12. The wrap and stretch roll 13A is disposed on an upstream side (left side in FIG. 1) in the direction of conveyance of the recording medium P in view from a hardening device 23 which will be described later. The wrap and stretch roll 13B is disposed on a downstream side (right side in FIG. 1) in the direction of conveyance of the recording medium P in view from the wrap and stretch roll 13A and the hardening device 23.

The wrap and stretch roll 13C is disposed on a downstream side (right side in FIG. 1) in the direction of conveyance of the recording medium P in view from the wrap and stretch roll 13B but on a side (upper side in FIG. 1) opposite to the side on which the conveyance belt 40 is disposed. The wrap and stretch roll 13D is disposed on an upstream side (left side in FIG. 1) in the direction of conveyance of the recording medium P in view from the wrap and stretch roll 13A but on a side (upper side in FIG. 1) opposite to the side on which the conveyance belt 40 is disposed.

At least one of the wrap and stretch rolls 13A, 13B, 13C and 13D pushes the transfer body 12 toward its outer circumferential side to give tension to the transfer body 12. Configuration is made so that the transfer body 12 rotates (moves circularly) in one direction (counterclockwise in FIG. 1) when any one of the wrap and stretch rolls 13A, 13B, 13C and 13D is driven to rotate by a drive portion (not shown).

The transfer body 12 has releasability (mold releasability) by which the hardenable solution layer 16A can be released. For example, a material having a high smoothness may be selected as the transfer body 12. Specifically, the transfer body 12 is, for example, made of ETFE (ethylene-teterafluoroethylene copolymer) or PET (polyethylene terephthalate). Incidentally, the transfer body 12 may be made of another material which is one member selected from various kinds of resin (such as polyimide, polyamide-imide, polyester, polyurethane, polyamide, polyether-sulfone, fluorocarbon resin, etc) and various kinds of rubber (such as nitrile rubber, ethylene-propylene rubber, chloroprene rubber, isoprene rubber, styrene rubber, butadiene rubber, butyl rubber, chlorosulfonated polyethylene, urethane rubber, epichlorohydrin rubber, acrylic rubber, silicone rubber, fluorocarbon rubber, etc). Alternatively, the transfer body 12 may be made of a metal material such as stainless steel, etc. The transfer body 12 may be formed as a single layer or may be formed as a laminated layer of the one kind of material or different kinds of materials.

Incidentally, the transfer body 12 may have a release layer (mold release layer) which is provided on its surface (outer circumferential surface) for making it easy to release the hardenable solution later 16A. For example, fluorocarbon resin material, silicone rubber or the like may be used as a material used in the release layer.

The transfer body 12 is not limited to the transfer belt. For example, a transfer drum may be used as the transfer body 12. The to-be-formed body is not limited to the transfer body 12. For example, any material may be used as the to-be-formed body as long as the hardenable solution layer 16A can be formed and the hardenable solution layer 16A can be released.

A first forming portion 18 which forms the hardenable solution layer 16A by supplying a hardenable solution 16 to be hardened in response to a stimulus onto a surface of the transfer body 12 is provided on an outer circumferential side (upper side in FIG. 1) of the transfer body 12. Specifically, the first forming portion 18 is disposed in a position opposite to an upper portion (a portion parting from the wrap and stretch roll 13C and coming into contact with the wrap and stretch roll 13D) of the transfer body 12 so that the hardenable solution 16 is supplied to the aforementioned portion of the transfer body 12.

Incidentally, the first forming portion 18 may be disposed above the wrap and stretch roll 13C on an outer circumferential side (upper side in FIG. 1) of the transfer body 12 so that the hardenable solution 16 is supplied to a potion of the transfer body 12 which is wrapped and stretched on the wrap and stretch roll 13C.

Specifically, the first forming portion 18 is made of a supply mechanism capable of supplying the hardenable solution 16 to a surface of the transfer body 12 selectively. More specifically, the first forming portion 18 is made of an ink jet recording head which discharges liquid drops of the hardenable solution 16 from nozzles by an ink jet method. This ink jet recording head is driven by a piezoelectric method, a thermal method, etc. so that liquid drops of the hardenable solution 16 are discharged onto the surface of the transfer body 12 moving relatively.

Moreover, the first forming portion 18 has a length along the widthwise direction of the transfer body 12 (i.e. along a direction perpendicular to the direction of rotation of the transfer body 12), so that the discharge length along the widthwise direction of the transfer body 12 is set to be not smaller than a discharge target region of the transfer body 12. That is, the first forming portion 18 is formed so that the first forming portion 18 does not move relative to the transfer body 12 in the widthwise direction of the transfer body 12 but liquid drops of the hardenable solution 16 can be discharged onto one line in the widthwise direction (primary scanning direction) of the discharge target region.

The first forming portion 18 is designed to form the hardenable solution layer 16A in accordance with a discharge region of the transfer body 12 onto which ink drops are discharged from an image forming portion 20 which will be described later. The term "discharge region" used herein means a region on which the image forming portion 20 is scheduled to form an image by discharging ink drops based on image information. The first forming portion 18 is designed to form the hardenable solution layer 16A by supplying the hardenable solution 16 to the discharge region of the image forming portion 20 based on the image information.

Accordingly, when the discharge region due to the image forming portion 20 is a partial region on the transfer body 12, the hardenable solution layer 16A due to the first forming portion 18 is formed partially (selectively) on the transfer body 12. When the discharge region due to the image forming portion 20 is the whole surface of a dischargeable region where the image forming portion 20 can discharge liquid drops onto transfer body 12, the hardenable solution layer 16A due to the first forming portion 18 is formed on the whole surface of the dischargeable region in the transfer body 12.

In this exemplary embodiment, there is provided a control potion 26 for controlling the first forming portion 18 and the image forming portion 20 which will be described later. The control portion 26 determines the timing of discharging the hardenable solution 16 in the first forming portion 18 and nozzles to be used in accordance with image information, so that the first forming portion 18 supplies the hardenable solution 16 to the discharge region of the image forming portion 20 based on the image information to thereby form the hardenable solution layer 16A.

Specifically, the control portion 26 is constituted by a computer which executes a program so that the computer serves as an acquisition unit which acquires image information, a determination unit which determines a discharge region for discharging ink drops onto the transfer body 12 in accordance with the image information acquired by the acquisition unit, and a control unit which controls the first forming portion 18 so that the hardenable solution layer 16A is formed in accordance with the discharge region determined by the determination unit. Although it is a matter of course that the program may be provided by a communication unit in an example, the program may be provided in a state where the program is stored in a recording medium such as a CD-ROM in another example.

Figure 2:
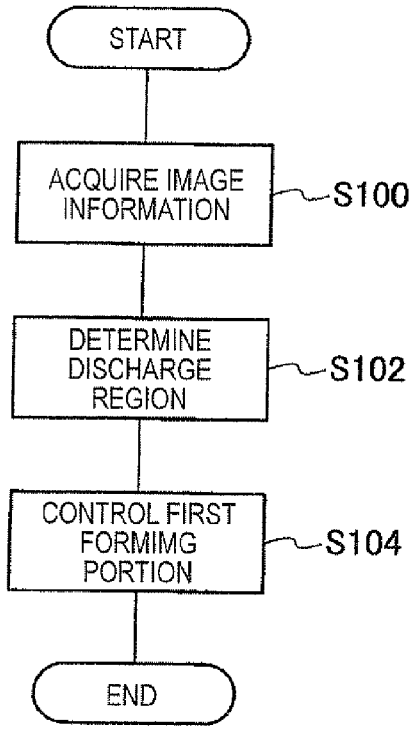
FIG. 2 is a control flow in a control portion according to the first exemplary embodiment.

That is, as shown in FIG. 2, the control portion 26 first acquires image information in step 100 (S100). In the next step 102, a discharge region of the transfer body 12 onto which ink drops are discharged is determined based on the image information acquired in the step 100 (S102). In the next step 104, the first forming portion 18 is controlled so that the hardenable solution layer 16A is formed for the discharge region determined in the step 102 (S104). Incidentally, the steps 100, 102 and 104 correspond to the acquisition unit, the determination unit and the control unit respectively.

Examples of the image information are image information generated in an external device and acquired from the external device, image information generated in the image forming apparatus 10 reading an image of an original document or the like, etc.

The first forming portion 18 may be configured to discharge the hardenable solution onto a region coincident with the discharge region or may be configured to discharge the hardenable solution onto a region including the discharge region and being larger than the discharge region. In the configuration that the hardenable solution is discharged onto a region larger than the discharge region, resolution in the first forming portion 18 may be lower than resolution in the image forming portion 20. For example, resolution in the image forming portion 20 is set to be 1200 dpi whereas resolution in the first forming portion 18 is set to be in a range of 150 dpi to 300 dpi, both inclusively.

The thickness of the hardenable solution layer 16A formed by the first forming portion 18 is set to be not smaller than the thickness of a particle layer 17A of liquid absorbing particles 17 (the volume mean particle diameter of liquid absorbing particles 17) formed by a second forming portion 19 which will be described later.

In the first forming portion 18, the viscosity of dischargeable liquid is set to be in a range of 1 mPa·s to 100 mPa·s, both inclusively. The viscosity of the hardenable solution 16 in an available environment is set to be in the aforementioned viscosity range. Incidentally, for example, the viscosity is measured by a viscosity/viscoelasticity measuring device MARSII made by HAAKE. The specific configuration of the hardenable solution 16 will be described later.

Incidentally, when the hardenable solution 16 has such a property that the viscosity is reduced by heating, configuration may be made so that the hardenable solution 16 is supplied in a state where the hardenable solution 16 is heated in the first forming portion 18 to reduce the viscosity of the hardenable solution 16.

The first forming portion 18 may be configured so that liquid drops are supplied from nozzles to the transfer body 12 in such a manner that liquid drops of the hardenable solution 16 are not flown in the air to be supplied onto the transfer body 12 but part of liquid drops coming out from nozzles by driving are brought into contact with the transfer body 12 so as to be moved onto the transfer body 12. In the first forming portion 18 configured as described above, the viscosity of liquid capable of being supplied onto the transfer body 12 is set to be in a range higher than the aforementioned viscosity range. The first forming portion 18 is not limited to the ink jet recording head. Another application device may be used as the first forming portion 18 as long as the device has a supply mechanism which is configured so that the hardenable solution 16 can be supplied selectively onto a surface of the transfer body 12.

A second forming portion 19 is provided on a downstream side of the first forming portion 18 in a rotating direction (moving direction) of the transfer body 12 so that the liquid absorbing particles 17 absorbing ink drops supplied onto the surface of the hardenable solution layer 16A are supplied onto the surface of the hardenable solution layer 16A formed by the first forming portion 18 to thereby form a layer (referred to as particle layer) 17A of the liquid absorbing particles 17. Specifically, the second forming portion 19 is made of a supply roll which is disposed so as to be opposite to the surface of the transfer body 12. The supply roll is a chargeable roll which is made of a metal material such as aluminum.

The second forming portion 19 is driven to rotate in a direction (clockwise in FIG. 1) opposite to the rotating direction of the transfer body 12 by a drive motor 25 as an example of a drive portion. Configuration is made in such a manner that the drive motor 25 drives the second forming portion 19 to rotate at a peripheral velocity in the same range as the peripheral velocity of the transfer body 12 so that the liquid absorbing particles 17 supplied onto the surface of the hardenable solution layer 16A form the particle layer 17A on the surface of the hardenable solution layer 16A. Incidentally, the term "same range" includes the case where a velocity difference is generated between the peripheral velocity of the second forming portion 19 and the peripheral velocity of the transfer body 12 as long as the liquid absorbing particles 17 supplied onto the surface of the hardenable solution layer 16A can form the particle layer 17A on the surface of the hardenable solution layer 16A.

The second forming portion 19 has a length along a widthwise direction of the transfer body 12 (a direction perpendicular to the rotating direction of the transfer body 12). The length along the widthwise direction is set to be not smaller than the discharge target region in the transfer body 12.

Figure 3:
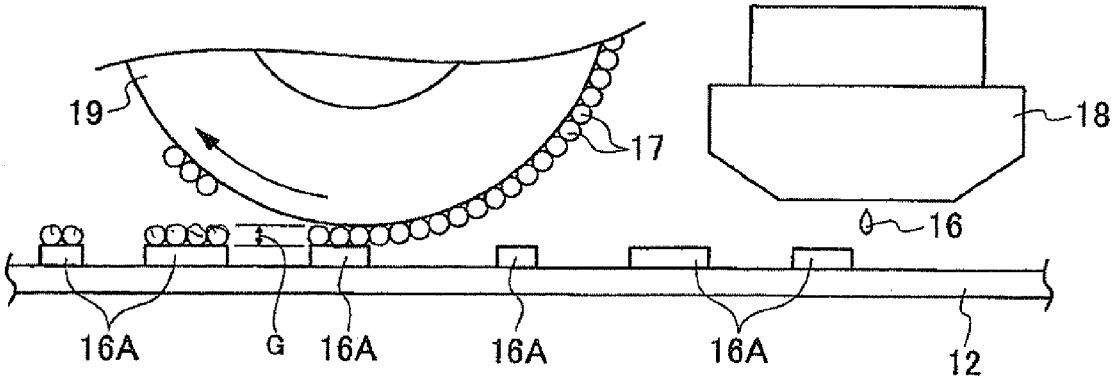
FIG. 3 is an enlarged view showing a broken-line portion K in FIG. 1.

As shown in FIG. 3, a gap G is formed between the second forming portion 19 and the transfer body 12 with the hardenable solution layer 16A formed thereon. This gap G is set to be not larger than the thickness of the particle layer 17A formed on surfaces (outer circumferential surfaces) of a giving roll 21C (which will be described later) and the second forming portion 19. The thickness of the particle layer 17A is set to be in a range of 1 μm to 20 μm, both inclusively. Incidentally, when the thickness of the particle layer 17A is grasped as being equal to the particle diameter of the liquid absorbing particles 17, the gap G is set to be not larger than the volume mean particle diameter of the liquid absorbing particles 17. The volume mean particle diameter of the liquid absorbing particles 17 is set to be in a range of 1 μm to 10 μm, both inclusively, and preferably in a range of 3 μm to 7 μm, both inclusively.

As shown in FIG. 1, a giving portion 21 is provided in a position (above the second forming portion 19 in FIG. 1) opposite to the second forming portion 19 and on an upstream side in the rotating direction of the second forming portion 19 relative to the transfer body 12 so that the giving portion 21 gives the liquid absorbing particles 17 to the second forming portion 19.

The giving portion 21 is provided with a casing 21A having an opening portion 21B opened to the second forming portion 19 side. A giving roll 21C which gives the liquid absorbing particles 17 to the second forming portion 19 is disposed in the casing 21A so as to be opposite to the second forming portion 19 so that a part of the outer circumference of the giving roll 21C is exposed through the opening portion 21B. The giving roll 21C is made of a chargeable roll having a surface (outer circumferential surface) on which a layer of the liquid absorbing particles 17 is held by electrostatic power. The liquid absorbing particles 17 are stored on a deep side (upper side in FIG. 1) of the giving roll 21C in the casing 21A.

A blade 21D as an example of a limiting member for limiting the thickness of the particle layer 17A of the liquid absorbing particles 17 held on the surface of the giving roll 21C is provided in the casing 21A. A cleaning roll 21E for cleaning liquid absorbing particles 17 not moving from the giving roll 21C to the second forming portion 19 but remaining on the surface of the giving roll 21C is provided so as to be adjacent to the giving roll 21C.

The giving portion 21 is configured so that the liquid absorbing particles 17 held on the surface of the giving roll 21C are continuously given to the second forming portion 19 by electrostatic power. Specifically, the giving roll 21C and the second forming portion 19 are charged with polarity (e.g. negative polarity) reverse to the charged liquid absorbing particles 17, so that the liquid absorbing particles 17 are supplied to the second forming portion 19 by a potential difference between the giving roll 21C and the second forming portion 19. The liquid absorbing particles 17 are frictionally charged, for example, by friction between the liquid absorbing particles 17 due to stirring, friction between the blade 21D and the liquid absorbing particles 17, etc. Incidentally, the specific configuration of the liquid absorbing particles 17 will be described later.

Incidentally, the giving portion 21 has a length along a widthwise direction of the transfer body 12 (a direction perpendicular to the rotating direction of the transfer body 12). The length along the widthwise direction of the transfer body 12 is set to be not smaller than the discharge target region in the transfer body 12.

Configuration is made so that the giving roll 21C is driven to rotate in a direction (counterclockwise in FIG. 1) opposite to the rotating direction of the second forming portion 19 by a drive portion (not shown). The drive portion drives the giving roll 21C to rotate in a peripheral velocity of the same range as the peripheral velocity of the second forming portion 19 so that the liquid absorbing particles 17 supplied onto the surface (outer circumferential surface) of the second forming portion 19 form the particle layer 17A on the surface of the second forming portion 19. Incidentally, the term "same range" includes the case where a velocity difference is generated between the peripheral velocity of the second forming portion 19 and the peripheral velocity of the giving roll 21C as long as the liquid absorbing particles 17 supplied onto the surface of the second forming portion 19 can form the particle layer 17A on the surface of the second forming portion 19.

The adhesive power of the hardenable solution layer 16A to the liquid absorbing particles 17 is set to be larger than the holding power of the second forming portion 19 for holding the liquid absorbing particles 17 by electrostatic power. That is, in the second forming portion 19, the liquid absorbing particles 17 held by electrostatic power are brought into contact with the hardenable solution layer 16A so that the liquid absorbing particles 17 are supplied onto the surface of the hardenable solution layer 16A by the adhesive power of the hardenable solution 16 to the liquid absorbing particles 17 to thereby form the particle layer 17A. It is conceived that the term "adhesive power" used herein includes adhesive power exhibited by the liquid absorbing particles 17 absorbing the hardenable solution 16, surface tension of the hardenable solution 16 in surfaces of the liquid absorbing particles 17, and viscosity of the hardenable solution per se.

As described above, in the second forming portion 19, the liquid absorbing particles 17 are held as a layer (stratiformly) on the surface of the second forming portion 19 by electrostatic power, so that the held layer of the liquid absorbing particles 17 is transplanted onto the surface of the hardenable solution layer 16A. That is, the second forming portion 19 can be grasped as an example of a transplantation portion because the second forming portion 19 serves as a transplantation portion by which the layer of the liquid absorbing particles 17 held on the surface of the second forming portion 19 is transplanted onto the surface of the hardenable solution layer 16A.

Incidentally, even when the liquid absorbing particles 17 held on the second forming portion 19 by electrostatic power come into contact with the transfer body 12, the liquid absorbing particles 17 are not adsorbed by the transfer body 12 but go back to the giving portion 21 while held on the second forming portion 19.

An image forming portion 20 which forms an image by discharging liquid drops to be absorbed to the liquid absorbing particles 17 onto the surface of the hardenable solution layer 16A with the particle layer 17A formed by the second forming portion 19 is provided on a downstream side of the second forming portion 19 in the rotating direction of the transfer body 12 so as to be located on an outer circumferential side (upper side in FIG. 1) of the transfer body 12.

The image forming portion 20 has a discharge portion 20K for discharging black ink drops, a discharge portion 20C for discharging cyan ink drops, a discharge portion 20M for discharging magenta ink drops, and a discharge portion 20Y for discharging yellow ink drops, for example, in order from an upstream side in the rotating direction of the transfer body 12.

Specifically, the image forming portion 20 is constituted by an ink jet recording head which discharges ink drops from nozzles by an ink jet method. This ink jet recording head is driven by a piezoelectric method, a thermal method, etc. so that ink drops are discharged onto the surface of the hardenable solution layer 16A moving relatively. When ink drops are discharged onto the surface of the hardenable solution layer 16A from the image forming portion 20 in this manner, the ink drops are supplied onto the surface of the hardenable solution layer 16A.

In the image forming portion 20, nozzles to be used and the discharge timing of each nozzle are determined by the control portion 26 based on image information so that an image corresponding to the image information is formed by discharge of ink drops.

The image forming portion 20 has a length along a widthwise direction of the transfer body 12 (a direction perpendicular to the rotating direction of the transfer body 12). The discharge length along the widthwise direction of the transfer body 12 is set to be not smaller than the discharge target region in the transfer body 12. That is, the image forming portion 20 is configured so that the image forming portion 20 does not move relative to the transfer body 12 in the widthwise direction of the transfer body 12 but can discharge ink drops on one line in the widthwise direction (primary scanning direction) of the discharge target region.

Examples of ink discharged by the image forming portion 20 are water-based ink containing an aqueous solvent as a solvent, oil-based ink containing an oily solvent as a solvent, ultraviolet-curable ink, phase-change wax ink, etc. The configuration of these kinds of ink is not specifically limited but any known configuration may be used as long as the ink can be absorbed to the liquid absorbing particles 17.

The image forming portion 20 is not limited to the ink jet recording head but any discharge mechanism may be used as long as ink drops can be selectively discharged onto the surface of the transfer body 12.

Pressure members 22 for pressing the hardenable solution layer 16A with discharged ink drops against the recording medium P are provided on a downstream side of the image forming portion 20 in the rotating direction of the transfer body 12 so that the transfer body 12 is put between the pressure members 22 on the inner circumferential side and the outer circumferential side.

Specifically, the pressure members 22 include a wrap and stretch roll 13A on which the transfer body 12 is wrapped and stretched, and a pressure roll 48 disposed on an inner circumferential side of the conveyance belt 40. The pressure members 22 are formed so that the recording medium P is conveyed while the recording medium P is put between the transfer body 12 and the conveyance belt 40 in a state where the pressure roll 48 gives pressure to the wrap and stretch roll 13A side. As a result, the hardenable solution layer 16A on the surface of the transfer body 12 comes into contact with the recording medium P in the transfer region ranging from a position where the transfer body 12, the recording medium P and the conveyance belt 40 are put between the pressure roll 48 and the wrap and stretch roll 13A to a position where they are put between the wrap and stretch roll 133 and the flat plate 22.

A hardening device 23 as an example of a transfer portion for transferring the hardenable solution layer 16A with an image formed by the image forming portion 20 onto the recording medium P is provided on a downstream side of the pressure members 22 in the rotating direction of the transfer body 12 so as to be located on an inner circumferential side of the transfer body 12. This hardening device 23 gives a stimulus to the hardenable solution layer 16A being in contact with the recording medium P in the transfer region so that the hardenable solution layer 16A is transferred onto the recording medium P from the transfer body 12 while the hardenable solution 16 is hardened. Incidentally, the specific configuration of the hardening device 23 will be described later.

A removing device 24 which removes the hardenable solution 16 remaining on the surface of the transfer body 12 is provided on a downstream side of the hardening device 23 in the rotating direction of the transfer body 12 so as to be located on an outer circumferential side of the transfer body 12. Specifically, the removing device 24 is disposed on a side of the transfer body 12 so as to be opposite to a portion of the transfer body 12 parting from the wrap and stretch roll 13B and coming into contact with the wrap and stretch roll 13C.

The removing device 24 has a removing member 24A which comes into contact with the transfer body 12 to scrape off the hardenable solution 16 remaining on the transfer body 12. For example, the removing member 24A is constituted by a plate-like blade made of a rubber material. The removing device 24 further has a storage portion 24B which stores the hardenable solution 16 scraped off by the removing member 24A. The storage portion 24B is constituted by a box opened to a side facing the transfer body 12 and serves as a receiving portion which receives the hardenable solution 16 scraped off and dropped down by the removing member 24A.

As described above, in this exemplary embodiment, the first forming portion 18 and the second forming portion 19 form a layer forming device 15 which forms layers (specifically, the hardenable solution layer 16A with the particle layer 17A formed on its surface) on the transfer body 12.

(Liquid Absorbing Particles 17)

The liquid absorbing particles 17 will be described next.

The liquid absorbing particles 17 are made of a material (liquid absorbing material) having liquid absorbing ability with respect to ink. The liquid absorbing material is provided so that when the liquid absorbing material and ink are mixed in a mass ratio of 30:100 for 24 hours and then the liquid absorbing material is taken out from the mixture solution by a filter, the mass of the liquid absorbing material increases by 5% or more compared with the mass of the liquid absorbing material which has been not mixed with ink yet. That is, the liquid absorbing particles 17 have a function of fetching an ink liquid component (such as water or an aqueous solvent) to fix an image based on ink.

Examples of the liquid absorbing material are resins, inorganic particles having surface ink-philia (such as silica, alumina and zeolite), etc. The liquid absorbing material is selected in accordance with ink to be used.

Specifically, when water-based ink is used as ink, it is preferable that a water absorbing material is used as the liquid absorbing material. When oil-based ink is used as ink, it is preferable that an oil absorbing material is used as the liquid absorbing material.

Specific examples of the water absorbing material include: polyacrylic acid and polyacrylate; polymetacrylic acid and polymetacrylate; copolymer composed of (meth)acrylic ester-(meth)acrylic acid and (meth)acrylate; copolymer composed of styrene-(meth)acrylic acid and (meth)acrylate; copolymer composed of styrene-(meta) acrylic ester-(meta) acrylic acid and (meth) acrylate; copolymer composed of ester generated from alcohol and (meth)acrylic acid and having aliphatic or aromatic substituents having a structure of styrene-(meth)acrylic acid ester-carboxylic acid and carboxylate; copolymer composed of ester generated from alcohol and (meth)acrylic acid and having aliphatic or aromatic substituents having a structure of (meth)acrylic acid ester-carboxylic acid and carboxylate; ethylene-(meth)acrylic acid copolymer; copolymer composed of butadiene-(meth)acrylic acid ester-(meth)acrylic acid and (meth)acrylate; copolymer composed of ester generated from alcohol and (meth)acrylic acid and having aliphatic or aromatic substituents having a structure of butadiene-(meth)acrylic acid ester-carboxylic acid and carboxylate; polymaleic acid and polymaleate; copolymer composed of styrene-maleic acid and maleate; the respective resins denatured with sulfonic acid; and the respective resins denatured with phosphoric acid. Preferred examples include: polyacrylic acid and polyacrylate; copolymer composed of styrene-(meth)acrylic acid and (meth)acrylate; copolymer composed of styrene-(meta)acrylic ester-(meta)acrylic acid and (meth)acrylate; copolymer composed of ester generated from alcohol and (meth)acrylic acid and having aliphatic or aromatic substituents having a structure of styrene-(meth)acrylic acid ester-carboxylic acid and carboxylate; and copolymer composed of (meth)acrylic acid ester-(meth)acrylic acid and (meth)acrylate. These resins may be non-cross-linked or may be cross-linked.

Specific examples of the oil absorbing material include: hydroxystearic acid; cholesterol derivatives; low molecular gelling agents such as benzylidene sorbitol; polynorbornene; polystyrene; polypropylene; styrene-butadiene copolymer; and various kinds of rosin. Preferred examples include: polynorbornene; polypropylene; and various kinds of rosin.

(Hardenable Solution 16)

The hardenable solution 16 will be described next.

The hardenable solution 16 at least contains a curable material which is cured by a stimulus (energy) given from the outside. The term "curable material which is cured by a stimulus (energy) given from the outside" contained in the hardenable solution 16 means a material which is cured as "curable resin" by a stimulus (energy) given from the outside. Specific examples of the curable material include: curable monomer; curable macromer; curable oligomer; and curable prepolymer. Incidentally, the liquid absorbing particles 17 are not contained in the hardenable solution 16.

The viscosity of the hardenable solution 16 is set to be in a dischargeable range in the first forming portion 18. The viscosity of the hardenable solution 16 is set to be in a range of 1 mPa·s to 100 mPa·s, both inclusively. When an amount of the liquid absorbing particles 17 required for absorbing and solidifying ink is dispersed, the hardenable solution 16 has a higher viscosity than the dischargeable viscosity in the first forming portion 18. Specifically, the viscosity of the hardenable solution 16 containing the liquid absorbing particles 17 is set to be in a range of 500 mPa·s to 2000 mPa·s, both inclusively. Accordingly, the first forming portion 18 is provided so that the hardenable solution 16 cannot be discharged when the hardenable solution 16 contains the liquid absorbing particles 17. Incidentally, for example, the viscosity is measured by a viscosity/viscoelasticity measuring device MARSII made by HAAKE.

Examples of the curable material include an ultraviolet-curable material, an electron beam-curable material, and a heat-curable material. The ultraviolet-curable material is easy to cure and easy to handle because the curing speed of the ultraviolet-curable material is higher than that of another material. The electron beam-curable material does not require any polymerization initiator, so that it is easy to perform control of coloring of a cured layer. The heat-curable material is cured without necessity of any large-scale device. Incidentally, the curable material is not limited to these. For example, a curable material cured by moisture, oxygen, etc. may be used. The curable material mentioned herein is irreversible after curing.

Examples of an "ultraviolet-cured resin" obtained by curing the ultraviolet-curable material include: an acrylic resin, a methacrylic resin, a urethane resin, a polyester resin, a maleimide resin, an epoxy resin, an oxetane resin, a polyether resin, and a polyvinylether resin. The hardenable solution 16 contains at least one member selected from ultraviolet-curable monomer, ultraviolet-curable macromer, ultraviolet-curable oligomer, and ultraviolet-curable prepolymer. It is preferable that the hardenable solution 16 contains an ultraviolet polymerization initiator for initiating an ultraviolet-curing reaction. The hardenable solution 16 may further contain a reaction assistant, a polymerization accelerator, etc. for more initiating polymerization reaction in accordance with necessity.

Examples of the ultraviolet-curable monomer include: radical curable materials such as acrylic acid ester of alcohol/polyhydric alcohol/amino alcohol, methacrylic acid ester of alcohol/polyhydric alcohol, acrylic aliphatic amide, acrylic alicyclic amide, and acrylic aromatic amide; and cationic curable materials such as epoxy monomer, oxetane monomer, and vinyl ether monomer. Besides materials obtained by polymerizing these monomers, radical curable materials, such as epoxy acrylate, urethane acrylate, polyester acrylate, polyether acrylate, urethane methacrylate, and polyester methacrylate, having acryloyl groups or methacryloyl groups added to an epoxy, urethane, polyester or polyether skeleton may be used as the ultraviolet-curable monomer, the ultraviolet-curable oligomer or the ultraviolet-curable prepolymer.

Examples of an "electron beam-cured resin" obtained by curing the electron beam-curable material include an acrylic resin, a methacrylic resin, a urethane resin, a polyester resin, a polyether resin, and a silicone resin. The hardenable solution 16 contains at least one member selected from electron beam-curable monomer, electron beam-curable macromer, electron beam-curable oligomer, and electron beam-curable prepolymer.

The same material as the ultraviolet-curable material may be used as the electron beam-curable monomer, the electron beam-curable macromer, the electron beam-curable oligomer or the electron beam-curable prepolymer.

Examples of a "heat-cured resin" obtained by curing the heat-curable material include an epoxy resin, a polyester resin, a phenol resin, a melamine resin, an urea resin, and an alkyd resin. The hardenable solution 16 contains at least one member selected from heat-curable monomer, heat-curable macromer, heat-curable oligomer, and heat-curable prepolymer. A curing agent may be added for polymerization. The hardenable solution 16 may contain a thermal polymerization initiator for initiating a heat-curing reaction.

Examples of the heat-curable monomer include: polyalcohols such as phenol, formaldehyde, bisphenol A, epichlorohydrin, amide cyanuryl, urea, glycerin, etc.; and acids such as phthalic anhydride, maleic anhydride, adipic acid, etc. Polymer obtained by polymerizing these monomers, epoxy prepolymer, polyester prepolymer, etc. may be used as the heat-curable macromer, the heat-curable oligomer or the heat-curable prepolymer.

As described above, any curable material may be used as long as the curable material can be cured (e.g. cured in accordance with the advance of a polymerizing reaction) by external energy such as ultraviolet rays, electron beams, heat, etc.

The hardenable solution may contain water or an organic solvent for dissolving or dispersing a main component (such as monomer, macromer, oligomer, prepolymer, polymerization initiator, etc.) contributing to the curing reaction. Incidentally, the percentage of the main component is set, for example, to be not lower than 30% by mass, preferably not lower than 60% by mass, more preferably not lower than 90% by mass.

(Hardening Device 23)

The configuration of the hardening device 23 will be described next.

The hardening device 23 is configured so that a stimulus (energy) is given to the hardenable solution layer 16A being in contact with the recording medium P through the transfer body 12. Accordingly, the transfer body 12 has a function of transmitting the stimulus to the hardenable solution layer 16A. For example, when ultraviolet rays or electron beams are used as the stimulus as will be described below, the transfer body 12 has a function of penetrating ultraviolet rays or electron beams. For example, when heat is used as the stimulus, the transfer body 12 has a function of transmitting heat.

Incidentally, the position of arrangement of the hardening device 23 is not limited to the inner circumferential side of the transfer body 12. The hardening device 23 may be disposed on the outer circumferential side of the transfer body 12, e.g. on the inner circumferential side of the conveyance belt 40. In this case, the transfer body 12 need not have the function of transmitting the stimulus to the hardenable solution layer 16A. When the hardening device 23 is disposed on the inner circumferential side of the conveyance belt 40, the conveyance belt 40 and the recording medium P need to have the function of transmitting the stimulus to the hardenable solution layer 16A. The hardening device 23 may be configured so that a stimulus is given to the hardenable solution layer 16A after the hardenable solution layer 16A is transferred onto the recording medium P.

The kind of the hardening device 23 is selected in accordance with the kind of the curable material contained in the hardenable solution 16 to be used. Specifically, when, for example, an ultraviolet-curable material cured by irradiation with ultraviolet rays is used, an ultraviolet ray irradiation device for irradiating the hardenable solution layer 16A with ultraviolet rays is used as the hardening device 23.

When an electron beam-curable material cured by irradiation with electron beams is used, an electron beam irradiation device for irradiating the hardenable solution layer 16A with electron beams is used as the hardening device 23.

When a heat-curable material cured by application of heat is used, a heat application device for applying heat on the hardenable solution layer 16A is used as the hardening device 23.

For example, a metal halide lamp, a high pressure mercury lamp, an ultra-high pressure mercury lamp, a deep ultraviolet lamp, a lamp using microwave for exciting a mercury lamp electrodelessly from the outside, an ultraviolet laser, a xenon lamp, a UV-LED, etc. may be used here as the ultraviolet ray irradiation device.

For example, a scanning type device, a curtain type device or the like is used as the electron beam irradiation device. The curtain type device is a device in which thermal electrons generated in a filament are led out by a grid in a vacuum chamber and further accelerated at one stroke by a high voltage (e.g. 70 to 300 kV) to thereby form an electron flow which is released to the atmospheric air side via window foil.

For example, a halogen lamp, a ceramic heater, a nichrome wire heater, a microwave heater, an infrared lamp, an electromagnetic induction type heater or the like is applied as the heat application device.

(Action According to the First Exemplary Embodiment)

An action according to the first exemplary embodiment will be described next.

In the image forming apparatus 10 according to this exemplary embodiment, the transfer body 12 first rotates so that the hardenable solution 16 is partially supplied from the first forming portion 18 to the transfer body 12 as shown in FIG. 1 to thereby form the hardenable solution layer 16A for the discharge region of the image forming portion 20.

Figure 4B:
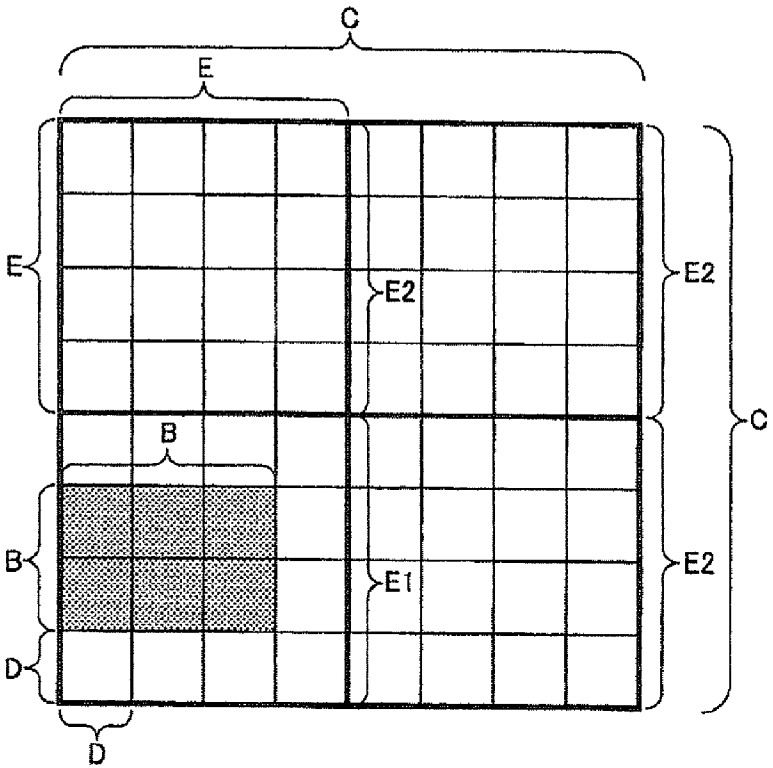
FIGS. 4A and 4B are explanatory views for explaining a discharge region due to an image forming portion and a region on which a hardenable solution layer is formed by a first forming portion.
Figure 4A:
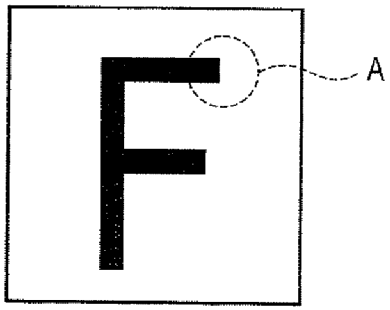

For example, when the image forming portion 20 is to discharge ink drops to form a character image "F" as shown in FIG. 4A, the hardenable solution 16 is supplied from the first forming portion 18 to a region including the discharge region and being larger than the discharge region (e.g. the discharge region (image region) and the discharge region's outer edge corresponding to a range of 0 to 2 dots, both inclusively) to thereby form the hardenable solution layer 16A.

FIG. 4B shows a portion surrounded by the broken line A in FIG. 4A. A dotted portion B in FIG. 4B shows a discharge region based on the image forming portion 20. A white portion C including the dotted portion B in FIG. 4B shows a region where the hardenable solution layer 16A is formed by the first forming portion 18. In FIG. 4B, one D of 64 (8×8) splits shows one dot in the image forming portion 20 whereas one E of 4 (2×2) splits shows one dot in the first forming portion 18. That is, FIG. 4B shows an example in which the hardenable solution 16 is discharged from the first forming portion 18 to one dot E1 including the discharge region (image region) of the image forming portion 20 and three dots E2 in total as an outer edge of the discharge region.

Then, as shown in FIG. 1, the hardenable solution layer 16A formed on the surface of the transfer body 12 is conveyed to a position opposite to the second forming portion 19, so that the layer of liquid absorbing particles 17 held on the surface of the second forming portion 19 rotating at a peripheral velocity of the same range as the peripheral velocity of the transfer body 12 is supplied (transplanted) onto the surface of the hardenable solution layer 16A by adhesive force of the hardenable solution layer 16A to the liquid absorbing particles 17. As a result, the liquid absorbing particles 17 are arranged tightly on the surface of the hardenable solution layer 16A to thereby form the particle layer 17A (see FIG. 5A). The liquid absorbing particles 17 are not supplied to a portion of the transfer body 12 without any hardenable solution layer 16A formed therein but are returned to the giving portion 21.

Incidentally, in the configuration of a comparative example in which the liquid absorbing particles 17 are not supplied to the surface of the hardenable solution layer 16A formed on the transfer body 12 but the hardenable solution 16 containing the liquid absorbing particles 17 dispersed in advance is supplied to the transfer body 12 to form a hardenable solution layer 116A (see FIG. 5B), the liquid absorbing particles 17 are not arranged tightly on the surface of the hardenable solution layer 16A compared with this exemplary embodiment.

The hardenable solution layer 16A supplied with the liquid absorbing particles 17 by the second forming portion 19 is conveyed to a position opposite to the image forming portion 20, so that ink drops of respective colors based on image information are discharged from discharge portions 20Y, 20M, 20C and 20K onto the surface of the hardenable solution layer 16A. As a result, the liquid absorbing particles 17 on the surface of the hardenable solution layer 16A absorb ink, so that a color image is formed on the surface of the transfer body 12.

Then, the hardenable solution layer 16A with the color image formed thereon comes into contact with the recording medium P in the transfer region. The hardenable solution layer 16A being in contact with the recording medium P is hardened through the transfer body 12 by the hardening device 23 and transferred onto the recording medium P.

Figure 5A:
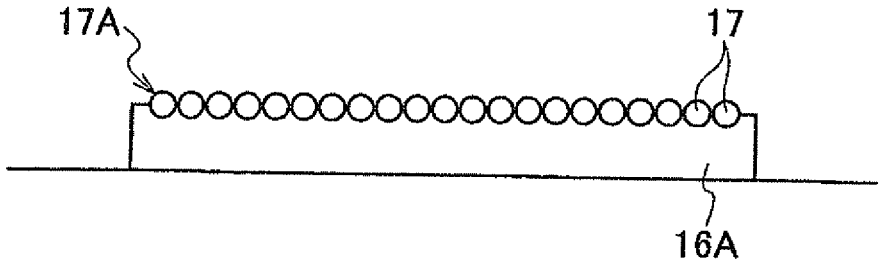
FIGS. 5A and 5B are comparison views for comparing a configuration in which a hardenable solution layer is formed from a hardenable solution containing liquid absorbing particles dispersed therein in advance with a configuration in which liquid absorbing particles are supplied to a surface of a hardenable solution layer.
Figure 5B:
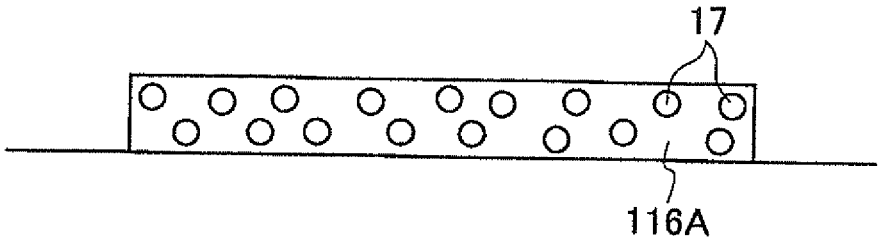

In this exemplary embodiment, as described above, the liquid absorbing particles 17 are arranged tightly on the surface of the hardenable solution layer 16A to thereby form the particle layer 17A (see FIG. 5A). As a result, image degradation caused by blurring of ink drops discharged from the image forming portion 20 onto the surface of the hardenable solution layer 16A can be suppressed compared with the configuration of the comparative example (see FIG. 5B) in which the hardenable solution 16 containing the liquid absorbing particles 17 dispersed therein in advance is supplied to the transfer body 12 to form the hardenable solution layer 116A.

The hardenable solution layer 16A partially formed on the surface of the transfer body 12 is transferred onto the recording medium P to thereby form a coated portion where the recording medium P is coated with the hardenable solution layer 16A and a uncoated portion where the recording medium P is not coated with the hardenable solution layer 16A (i.e. an exposed portion where the recording medium P is exposed). A material feeling of the hardenable solution layer 16A appears in the coated portion whereas a material feeling of the recording medium P appears in the uncoated portion. Incidentally, in this exemplary embodiment, in comparison between the material feeling of the coated portion (hardenable solution layer 16A) and the material feeling of the uncoated portion (recording medium P), luster of the uncoated portion is lower than luster of the coated portion.

Incidentally, after transferring onto the recording medium P, the hardenable solution 16 or the like remaining on the transfer body 12 is removed by the removing device 24.

[Second Exemplary Embodiment]

Figure 6:
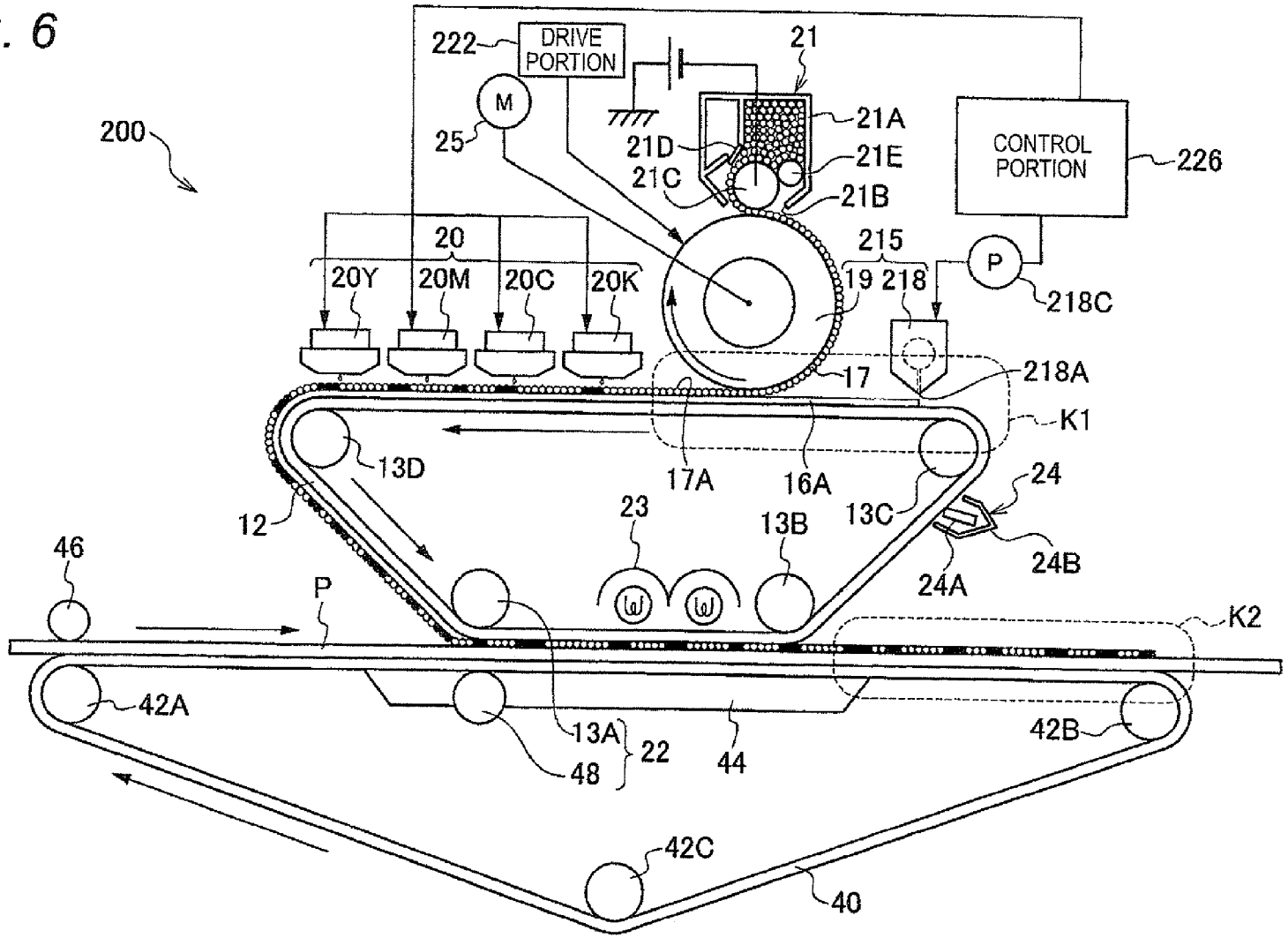
FIG. 6 is a schematic view showing the configuration of an image forming apparatus according to a second exemplary embodiment.

An image forming apparatus according to a second exemplary embodiment will be described next. FIG. 6 is a schematic view showing the configuration of the image forming apparatus according to the second exemplary embodiment. Incidentally, parts the same in configuration as those in the first exemplary embodiment are referred to by the same numerals and signs and description thereof will be omitted in accordance with necessity.

As shown in FIG. 6, the image forming apparatus 200 according to the second exemplary embodiment has a first forming portion 218 capable of changing the thickness of the hardenable solution layer 16A formed on the surface of the transfer body 12 to a plurality of thicknesses instead of the first forming portion 18 in the first exemplary embodiment.

The first forming portion 218 has a length along a widthwise direction of the transfer body 12 (a direction perpendicular to the rotating direction of the transfer body 12). The length along the widthwise direction of the transfer body 12 is set to be not smaller than the discharge target region in the transfer body 12.

The first forming portion 218 is provided to supply the hardenable solution 16 thickly to all the surface of the transfer body 12 regardless of the discharge region where liquid drops are discharged from the image forming portion 20. Specifically, for example, the first forming portion 218 is provided to form the hardenable solution layer 16A by supplying the hardenable solution 16 to the transfer body 12 continuously along the rotating direction of the transfer body 12 in all the region of a length allowing the image forming portion 20 to discharge ink drops (a length along the widthwise direction of the transfer body 12).

For example, the length of the hardenable solution layer 16A formed on the transfer body 12 along the rotating direction of the transfer body 12 is defined in accordance with the size of the recording medium P onto which the hardenable solution layer 16A is transferred. That is, the length of the hardenable solution layer 16A along the rotating direction of the transfer body 12 is set to be a length allowing the hardenable solution layer 16A to be transferred into the transfer surface of the recording medium P. Accordingly, the hardenable solution layer 16A in this exemplary embodiment is formed thickly substantially on (a range including) the whole region of the recording medium P substantially coincident with an image forming range in the image forming portion 20.

Specifically, the first forming portion 218 is made of a slit die and provided so that the hardenable solution 16 is discharged from a discharge hole (slit) 218A formed along one direction (specifically, the widthwise direction of the transfer body 12) onto the surface of the transfer body 12 without contact with the transfer body 12. The first forming portion 218 is configured so that the hardenable solution 16 is supplied by pressure of a pump 218C as an example of a drive device.

Incidentally, the first forming portion 218 is not limited thereto. For example, a well-known supply method (a coating method such as a blade type coating method, a roll type coating method, etc.) may be used. The first forming portion 218 may be configured so that the length of the hardenable solution layer 16A formed on the transfer body 12 along the widthwise direction of the transfer body 12 can be changed in accordance with the size of the recording medium P onto which the hardenable solution layer 16A is transferred.

In the second exemplary embodiment, a control portion 226 is configured to control the thickness of the hardenable solution layer 16A formed by the first forming portion 218. Specifically, the control portion 226 is formed so that the amount of the hardenable solution 16 supplied per time (per area of the transfer body 12) is controlled based on the pressure of the pump 218C to thereby control the thickness of the hardenable solution layer 16A formed by the first forming portion 218.

For example, control by the control portion 226 is performed based on an operating person's input operation. Specifically, the operating person selects a high gloss mode for expressing a high gloss feeling of the recording medium P after transferring of the hardenable solution layer 16A or a low gloss mode for expressing a (low gloss) mat feeling of the recording medium P after transferring of the hardenable solution layer 16A so that the control portion 226 performs control.

Incidentally, in this exemplary embodiment, because the hardenable solution 16 and the liquid absorbing particles 17 are supplied separately to the transfer body 12 so that the viscosity of the hardenable solution 16 is set to be lower than that in the case where the hardenable solution 16 contains the liquid absorbing particles 17, it is easier to control the thickness of the hardenable solution layer 16A.

Figure 7:
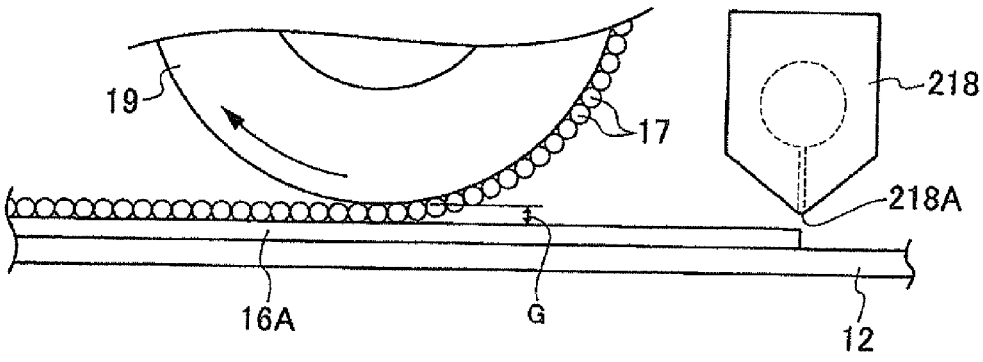
FIG. 7 is an enlarged view showing a broken-line portion K1 in FIG. 6.

As shown in FIG. 7, the second forming portion 19 is formed in the same manner as in the first exemplary embodiment, that is, a gap G to the transfer body 12 with the hardenable solution layer 16A formed thereon is set to be not smaller than the thickness of the particle layer 17A formed on the surfaces (outer circumferential surfaces) of the giving roll 21C and the second forming portion 19. The thickness of the particle layer 17A is set to be in a range of 1 μm to 20 mμ, both inclusively. Incidentally, when the thickness of the particle layer 17A is grasped to be equal to the particle diameter of the liquid absorbing particles 17, the gap G is set to be not larger than the volume mean particle size of the liquid absorbing particles 17. The volume mean particle size of the liquid absorbing particles 17 is set to be in a range of 1 μm to 10 mμ, both inclusively, and preferably in a range of 3 μm to 7 mμ, both inclusively.

The second forming portion 19 is provided so that the gap G can be changed in accordance with the thickness of the hardenable solution layer 16A. Specifically, the second forming portion 19 is configured so that the second forming portion 19 can be moved in an outer circumferential direction (upper in FIG. 6) of the transfer body 12 to go far from the transfer body 12 and in an inner circumferential direction (lower in FIG. 6) of the transfer body 12 to come close to the transfer body 12 by a drive portion 222 such as a linear actuator. That is, the drive portion 222 is configured so that, for example, the second forming portion 19 is not moved when the hardenable solution layer 16A has a predetermined first thickness (low gloss thickness) but the second forming portion 19 is moved toward the outer circumference of the transfer body 12 to keep the gap G when the hardenable solution layer 16A has a second thickness (high gloss thickness) larger than the first thickness. In this configuration, the giving portion 21 is moved together with the second forming portion 19.

Incidentally, configuration may be made so that the second forming portion 19 is not moved but the transfer body 12 is moved toward the second forming portion 19. For example, configuration is made in such a manner that a portion of the transfer body 12 opposite to the second forming portion 19 is pressed toward the second forming portion 19 side by a moving member such as a roll disposed in the inner circumference of the transfer body 12 so that the transfer body 12 comes close to the second forming portion 19.

The surface roughness of the transfer body 12 is set to be lower than the surface roughness of the hardenable solution layer 16A when roughness based on the liquid absorbing particles 17 is at least exposed in the surface. Accordingly, the surface roughness of the hardenable solution layer 16A brought into contact with the surface of the transfer body 12 and then transferred onto the recording medium P in the case where the roughness based on the liquid absorbing particles 17 is not exposed in the surface is set to be lower to obtain a high gloss than that in the case where the roughness based on the liquid absorbing particles 17 is exposed in the surface.

In this exemplary embodiment, the first forming portion 218 and the second forming portion 19 form a layer forming device 215 which forms a layer (specifically, the hardenable solution layer 16A with the particle layer 17A formed in its surface) on the transfer body 12.

(Operation According to the Second Exemplary Embodiment)

Operation according to the second exemplary embodiment will be described next.

In the image forming apparatus 200 according to this exemplary embodiment, the transfer body 12 rotates first so that the hardenable solution 16 is supplied thickly from the first forming portion 218 to the transfer body 12 to thereby form the hardenable solution layer 16A as shown in FIG. 6.

When the low gloss mode is selected by the operating person on this occasion, the first forming portion 218 forms the hardenable solution layer 16A with a predetermined first thickness (low gloss thickness). Specifically, for example, the first thickness is a thickness in a range of 100% to 120%, both inclusively, of the thickness of the particle layer 17A of the liquid absorbing particles 17 supplied by the second forming portion 19. Incidentally, when the low gloss mode is selected by the operating person, the second forming portion 19 is not moved by the drive portion 222 so that the gap G does not change.

On the other hand, when the high gloss mode is selected by the operating person, the first forming portion 218 forms the hardenable solution layer 16A with a second thickness (high gloss thickness) larger than the first thickness. Specifically, for example, the second thickness is a thickness not smaller than 200% of the thickness of the particle layer 17A of the liquid absorbing particles 17 supplied by the second forming portion 19. Incidentally, when the high gloss mode is selected by the operating person, the second forming portion 19 is moved by the drive portion 222 so that the gap G is enlarged.

Then, the hardenable solution layer 16A formed on the surface of the transfer body 12 is conveyed to a position opposite to the second forming portion 19, so that the layer of the liquid absorbing particles 17 held on the surface of the second forming portion 19 rotating at a peripheral velocity of the same range as the peripheral velocity of the transfer body 12 is supplied (transplanted) to the surface of the hardenable solution layer 16A by adhesive force of the hardenable solution layer 16A to the liquid absorbing particles 17. As a result, the liquid absorbing particles 17 are arranged tightly in the surface of the hardenable solution layer 16A, so that the particle layer 17A is formed (see FIG. 5A). The liquid absorbing particles 17 are not supplied to a portion of the transfer body 12 on which the hardenable solution layer 16A is not formed, so that the liquid absorbing particles 17 return to the giving portion 21.

Incidentally, in the configuration of a comparative example (see FIG. 5B) in which the liquid absorbing particles 17 are not supplied to the surface of the hardenable solution layer 16A formed on the transfer body 12 but the hardenable solution 16 containing the liquid absorbing particles 17 dispersed therein in advance is supplied to the transfer body 12 to form a hardenable solution layer 116A, the liquid absorbing particles 17 are not arranged tightly in the surface of the hardenable solution layer 16A.

The hardenable solution layer 16A supplied with the liquid absorbing particles 17 by the second forming portion 19 is conveyed to a position opposite to the image forming portion 20, so that ink drops of respective colors based on image information are discharged from the discharge portions 20Y, 20M, 20C and 20K onto the surface of the hardenable solution layer 16A. As a result, the liquid absorbing particles 17 in the surface of the hardenable solution layer 16A absorb ink, so that a color image is formed on the surface of the transfer body 12.

Then, the hardenable solution layer 16A with the color image formed thereon comes into contact with the recording medium P in the transfer region. The hardenable solution layer 16A being in contact with the recording medium P is hardened through the transfer body 12 by the hardening device 23, so that the image is transferred onto the recording medium P.

In this exemplary embodiment, as described above, the liquid absorbing particles 17 are arranged tightly on the surface of the hardenable solution layer 16A to thereby form the particle layer 17A (see FIG. 5A). As a result, image degradation caused by blurring of ink drops discharged from the image forming portion 20 to the surface of the hardenable solution layer 16A is suppressed compared with the configuration of the comparative example (see FIG. 5B) in which the hardenable solution 16 containing the liquid absorbing particles 17 dispersed therein in advance is supplied to the transfer body 12 to form the hardenable solution layer 116A.

Incidentally, the hardenable solution 16 etc. remaining on the transfer body 12 after transferring onto the recording medium P is removed by the removing device 24.

Figure 8A:
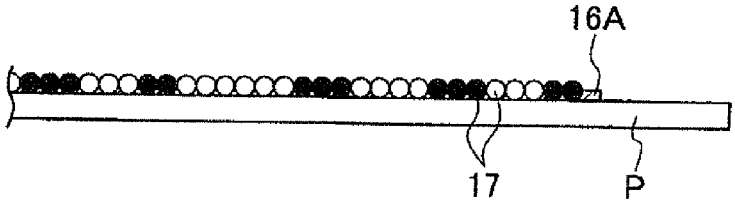
FIGS. 8A and 8B are enlarged views showing a broken-line portion K2 in FIG. 6.

When the hardenable solution layer 16A transferred onto the recording medium P has a first thickness (low gloss thickness) as shown in FIG. 8A, roughness of the liquid absorbing particles 17 appears in the surface of the recording medium P to thereby express a (low gloss) mat feeling.

Figure 8B:
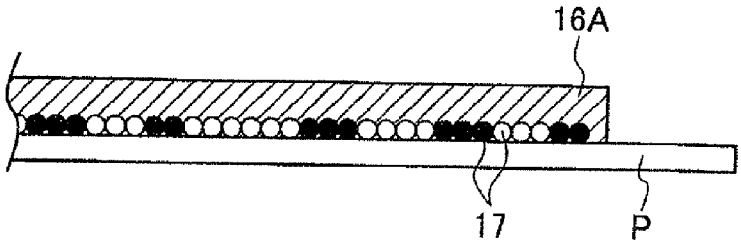

On the other hand, when the hardenable solution layer 16A transferred onto the recording medium P has a second thickness (high gloss thickness) as shown in FIG. 8B, roughness of the liquid absorbing particles 17 does not appear in the surface of the recording medium P to thereby express a high gloss feeling.

Although this exemplary embodiment has been described in the case where the gloss of the recording medium P (the thickness of the hardenable solution layer 16A) is controlled by the operating person's twofold selection between the high gloss mode and the low gloss mode, the gloss of the recording medium P (the thickness of the hardenable solution layer 16A) may be controlled by threefold or more selection. The gloss of the recording medium P (the thickness of the hardenable solution layer 16A) may be controlled by another method than the operating person's input operation or may be controlled regardless of mode selection.

[Third Exemplary Embodiment]

Figure 9:
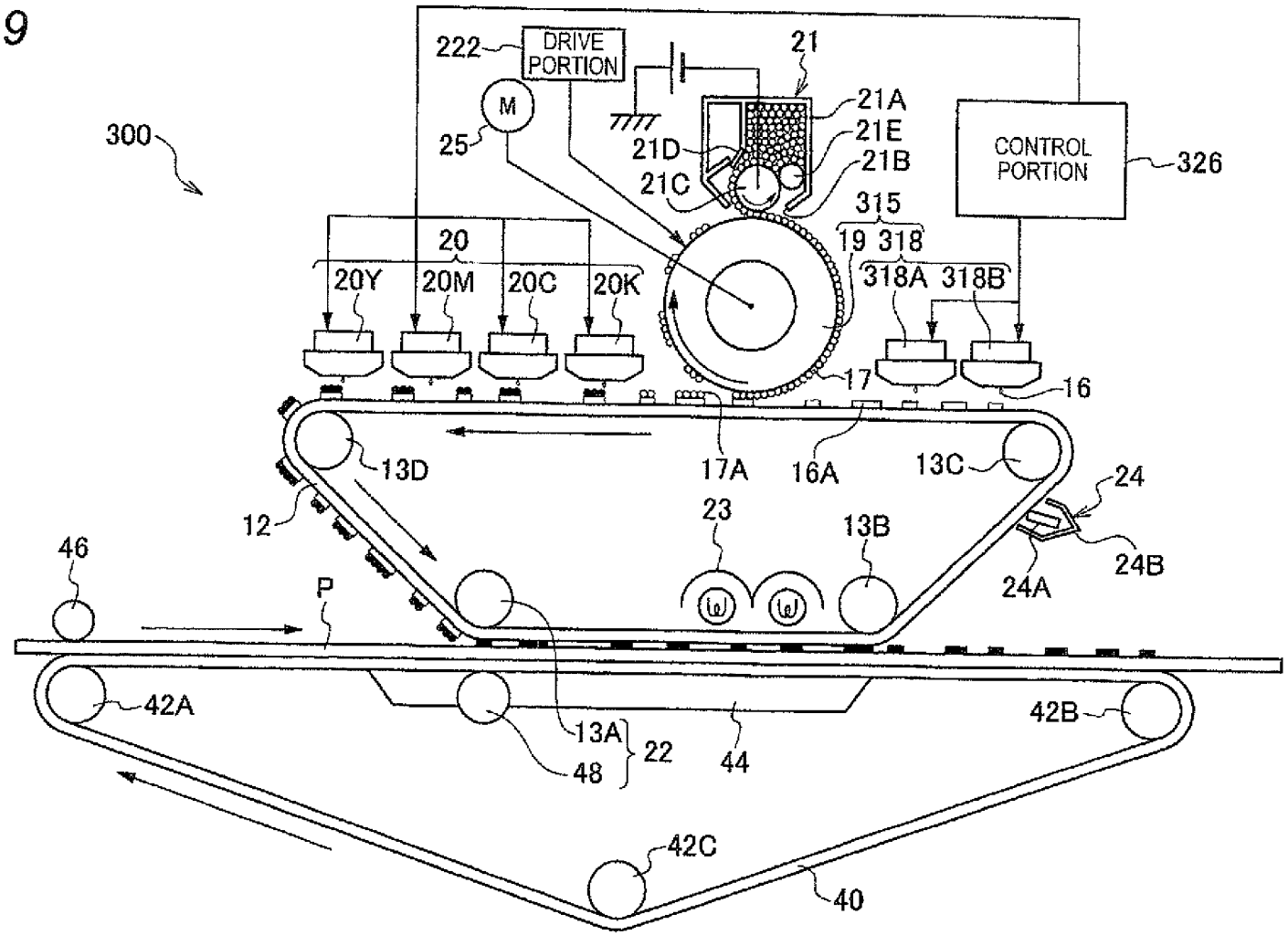
FIG. 9 is a schematic view showing the configuration of an image forming apparatus according to a third exemplary embodiment.

An image forming apparatus according to a third exemplary embodiment will be described next. FIG. 9 is a schematic view showing the configuration of the image forming apparatus according to the third exemplary embodiment. Incidentally, parts the same in configuration as those in the first exemplary embodiment are referred to by the same numerals and signs and description thereof will be omitted in accordance with necessity.

As shown in FIG. 9, the image forming apparatus 300 according to the third exemplary embodiment has a first forming portion 318 composed of a plurality of supply mechanisms capable of selectively supplying the hardenable solution 16 to the surface of the transfer body 12 instead of the first forming portion 18 in the first exemplary embodiment. Specifically, the first forming portion 318 is composed of ink jet recording heads 318A and 318B which discharge liquid drops of the hardenable solution 16 from nozzles by an ink jet method. The ink jet recording heads 318A and 318B are driven by a piezoelectric method, a thermal method, etc. so that liquid drops of the hardenable solution 16 are discharged onto the surface of the transfer body 12 moving relatively.

The ink jet recording heads 318A and 318B have a length along a widthwise direction of the transfer body 12 (a direction perpendicular to the rotating direction of the transfer body 12). The discharge length along the widthwise direction of the transfer body 12 is set to be not smaller than the discharge target region in the transfer body 12. That is, the ink jet recording heads 318A and 318B do not move relative to the transfer body 12 in the widthwise direction of the transfer body 12 but are configured so that liquid drops of the hardenable solution 16 can be discharged onto one line in the widthwise direction (primary scanning direction) of the discharge target region.

The ink jet recording heads 318A and 318B are provided to form the hardenable solution layer 16A for the discharge region of the transfer body 12 onto which ink drops are discharged from the image forming portion 20. The term "discharge region" mentioned herein means a region of the image forming portion 20 scheduled to discharge ink drops based on image information. The ink jet recording heads 318A and 318B supply the hardenable solution 16 to the discharge region of the image forming portion 20 based on the image information to thereby form the hardenable solution layer 16A.

Accordingly, when the discharge region of the image forming portion 20 is a partial region in the transfer body 12, the hardenable solution layer 16A based on the ink jet recording heads 318A and 318B is formed partially on the transfer body 12. When the discharge region of the image forming portion 20 is the whole surface of the dischargeable region of the transfer body 12 onto which the image forming portion 20 can discharge liquid drops, the hardenable solution layer 16A based on the ink jet recording heads 318A and 318B is formed on the whole surface of the dischargeable region in the transfer body 12.

The ink jet recording heads 318A and 318B may be configured to discharge the hardenable solution 16 to a region coincident with the discharge region or may be configured to discharge the hardenable solution 16 to a region containing the discharge region and being larger than the discharge region. In the configuration in which the hardenable solution 16 is discharged to the region larger than the discharge region, resolution of the first forming portion 318 may be lower than that of the image forming portion 20. For example, when resolution of the image forming portion 20 is 1200 dpi, resolution of the ink jet recording heads 318A and 318B is set to be in a range of 150 dpi to 300 dpi, both inclusively.

The viscosity of liquid allowed to be discharged from the ink jet recording heads 318A and 318B is set to be in a range of 1 mPa·s to 100 mPa·s, both inclusively. The viscosity of the hardenable solution 16 in an available environment is set to be in the aforementioned viscosity range. Incidentally, for example, the viscosity is measured by a viscosity/viscoelasticity measuring device MARSII made by HAAKE.

Incidentally, when the hardenable solution 16 has such a property that the viscosity is reduced by heating, configuration may be made so that the hardenable solution 16 is supplied in a state where the hardenable solution 16 is heated in the first forming portion 318 to reduce the viscosity of the hardenable solution 16.

The ink jet recording heads 318A and 318B may be configured so that liquid drops are supplied from nozzles to the transfer body 12 in such a manner that liquid drops of the hardenable solution 16 are not flown in the air to be supplied onto the transfer body 12 but part of liquid drops coming out from nozzles by driving are brought into contact with the transfer body 12 so as to be moved onto the transfer body 12. In the ink jet recording heads 318A and 318B configured as described above, the viscosity of liquid capable of being supplied onto the transfer body 12 is set to be in a range higher than the aforementioned viscosity range. The first forming portion 318 is not limited to the ink jet recording heads. Another application device may be used as the first forming portion 318 as long as the device has a supply mechanism which is configured so that the hardenable solution 16 can be supplied selectively onto the surface of the transfer body 12.

In this exemplary embodiment, a control portion 326 is provided to control the ink jet recording heads 318A and 318B and the image forming portion 20. The control portion 326 determines the timing of discharging the hardenable solution 16 in the ink jet recording heads 318A and 318B and nozzles to be used in accordance with image information, so that the ink jet recording heads 318A and 319B supply the hardenable solution 16 to the discharge region of the image forming portion 20 based on the image information to thereby form the hardenable solution layer 16A.

Specifically, the control portion 326 is made of a computer in the same manner as the control portion 26 in the first exemplary embodiment. The computer executes a program so that the computer serves as an acquisition unit which acquires image information, a determination unit which determines a discharge region for discharging ink drops onto the transfer body 12 in accordance with the image information acquired by the acquisition unit, and a control unit which controls the ink jet recording heads 318A and 318B so that the hardenable solution layer 16A is formed for the discharge region determined by the determination unit.

Examples of the image information include image information generated in an external device and acquired from the external device, image information generated in the image forming apparatus 10 reading an image of an original document or the like, etc.

In the third exemplary embodiment, the control portion 326 is configured to control the thickness of the hardenable solution layer 16A formed by the first forming portion 318. Specifically, the control portion 326 is formed to supply the hardenable solution 16 from either or both of the ink jet recording heads 318A and 318B to thereby control the thickness of the hardenable solution layer 16A formed by the first. forming portion 318.

For example, control by the control portion 326 is performed based on an operating person's input operation. Specifically, the operating person selects a high gloss mode for expressing a high gloss feeling of the recording medium P after transferring of the hardenable solution layer 16A or a low gloss mode for expressing a (low gloss) mat feeling of the recording medium P after transferring of the hardenable solution layer 16A so that the control portion 326 performs control.

A gap G between the second forming portion 19 and the transfer body 12 with the hardenable solution layer 16A formed thereon is set to be not larger than the thickness of the particle layer 17A formed on surfaces (outer circumferential surfaces) of the giving roll 21C and the second forming portion 19 (see FIG. 3). The thickness of the particle layer 17A is set to be in a range of 1 μm to 20 μm, both inclusively. Incidentally, when the thickness of the particle layer 17A is grasped as being equal to the particle diameter of the liquid absorbing particles 17, the gap G is set to be not larger than the volume mean particle diameter of the liquid absorbing particles 17. The volume mean particle diameter of the liquid absorbing particles 17 is set to be in a range of 1 μm to 10 μm, both inclusively, and preferably in a range of 3 μm to 7 μm, both inclusively.

The second forming portion 19 is provided so that the gap G can be changed in accordance with the thickness of the hardenable solution layer 16A. Specifically, the second forming portion 19 is configured so that the second forming portion 19 can be moved in an outer circumferential direction (upper side in FIG. 9) of the transfer body 12 to go far from the transfer body 12 and in an inner circumferential direction (lower side in FIG. 9) of the transfer body 12 to come close to the transfer body 12 by a drive portion 222 such as a linear actuator. That is, the drive portion 222 is configured so that, for example, the second forming portion 19 is not moved when the hardenable solution layer 16A has a predetermined first thickness (low gloss thickness) but the second forming portion 19 is moved toward the outer circumference of the transfer body 12 to keep the gap G when the hardenable solution layer 16A has a second thickness (high gloss thickness) larger than the first thickness. In this configuration, the giving portion 21 is moved together with the second forming portion 19.

Incidentally, configuration may be made so that the second forming portion 19 is not moved but the transfer body 12 is moved toward the second forming portion 19. For example, configuration is made in such a manner that a portion of the transfer body 12 opposite to the second forming portion 19 is pressed toward the second forming portion 19 side by a moving member such as a roll disposed in the inner circumference of the transfer body 12 so that the transfer body 12 comes close to the second forming portion 19.

The surface roughness of the transfer body 12 is set to be lower than the surface roughness of the hardenable solution layer 16A when roughness based on the liquid absorbing particles 17 is at least exposed in the surface. Accordingly, the surface roughness of the hardenable solution layer 16A brought into contact with the surface of the transfer body 12 and then transferred onto the recording medium P in the case where the roughness based on the liquid absorbing particles 17 is not exposed in the surface is set to be lower to obtain a high gloss than that in the case where the roughness based on the liquid absorbing particles 17 is exposed in the surface.

In this exemplary embodiment, the first forming portion 318 and the second forming portion 19 form a layer forming device 315 which forms a layer (specifically, the hardenable solution layer 16A with the particle layer 17A formed in its surface) on the transfer body 12.

(Operation According to the Third Exemplary Embodiment)

Operation according to the third exemplary embodiment will be described next.

In the image forming apparatus 300 according to this exemplary embodiment, the transfer body 12 rotates first so that the hardenable solution 16 is supplied partially from the first forming portion 318 to the transfer body 12 to thereby form the hardenable solution layer 16A for the discharge region of the image forming portion 20 as shown in FIG. 9.

When the low gloss mode is selected by the operating person on this occasion, the hardenable solution 16 is supplied from either of the ink jet recording heads 318A and 318B to form the hardenable solution layer 16A with a predetermined first thickness (low gloss thickness). Specifically, for example, the first thickness is a thickness in a range of 100% to 120%, both inclusively, of the thickness of the particle layer 17A of the liquid absorbing particles 17 supplied by the second forming portion 19. Incidentally, when the low gloss mode is selected by the operating person, the second forming portion 19 is not moved by the drive portion 222 so that the gap G does not change.

On the other hand, when the high gloss mode is selected by the operating person, the hardenable solution 16 is supplied from both the ink jet recording heads 318A and 318B to form the hardenable solution layer 16A with a second thickness (high gloss thickness) larger than the first thickness. Specifically, for example, the second thickness is a thickness not smaller than 200% of the thickness of the particle layer 17A of the liquid absorbing particles 17 supplied by the second forming portion 19. Incidentally, when the high gloss mode is selected by the operating person, the second forming portion 19 is moved by the drive portion 222 so that the gap G is enlarged.

Then, the hardenable solution layer 16A formed on the surface of the transfer body 12 is conveyed to a position opposite to the second forming portion 19, so that the layer of the liquid absorbing particles 17 held on the surface of the second forming portion 19 rotating at a peripheral velocity of the same range as the peripheral velocity of the transfer body 12 is supplied (transplanted) to the surface of the hardenable solution layer 16A by adhesive force of the hardenable solution layer 16A to the liquid absorbing particles 17. As a result, the liquid absorbing particles 17 are arranged tightly in the surface of the hardenable solution layer 16A, so that the particle layer 17A is formed (see FIG. 5A). The liquid absorbing particles 17 are not supplied to a portion of the transfer body 12 on which the hardenable solution layer 16A is not formed, so that the liquid absorbing particles 17 return to the giving portion 21.

Incidentally, in the configuration of the comparative example (see FIG. 5B) in which the liquid absorbing particles 17 are not supplied to the surface of the hardenable solution layer 16A formed on the transfer body 12 but the hardenable solution 16 containing the liquid absorbing particles 17 dispersed therein in advance is supplied to the transfer body 12 to form a hardenable solution layer 116A, the liquid absorbing particles 17 are not arranged tightly in the surface of the hardenable solution layer 16A compared with this exemplary embodiment.

The hardenable solution layer 16A supplied with the liquid absorbing particles 17 by the second forming portion 19 is conveyed to a position opposite to the image forming portion 20, so that ink drops of respective colors based on image information are discharged from the discharge portions 20Y, 20M, 20C and 20K onto the surface of the hardenable solution layer 16A. As a result, the liquid absorbing particles 17 in the surface of the hardenable solution layer 16A absorb ink, so that a color image is formed on the surface of the transfer body 12.

Then, the hardenable solution layer 16A with the color image formed thereon comes into contact with the recording medium P in the transfer region. The hardenable solution layer 16A being in contact with the recording medium P is hardened through the transfer body 12 by the hardening device 23, so that the image is transferred onto the recording medium P.

In this exemplary embodiment, as described above, the liquid absorbing particles 17 are arranged tightly on the surface of the hardenable solution layer 16A to thereby form the particle layer 17A (see FIG. 5A). As a result, image degradation caused by blurring of ink drops discharged from the image forming portion 20 to the surface of the hardenable solution layer 16A is suppressed compared with the configuration of the comparative example (see FIG. 5B) in which the hardenable solution 16 containing the liquid absorbing particles 17 dispersed therein in advance is supplied to the transfer body 12 to form the hardenable solution layer 116A.

Incidentally, the hardenable solution 16 etc. remaining on the transfer body 12 after transferring onto the recording medium P is removed by the removing device 24.

When the hardenable solution layer 16A transferred onto the recording medium P has a first thickness (low gloss thickness) as shown in FIG. 8A, roughness of the liquid absorbing particles 17 appears in the surface of the recording medium P to thereby express a (low gloss) mat feeling.

On the other hand, when the hardenable solution layer 16A transferred onto the recording medium P has a second thickness (high gloss thickness) as shown in FIG. 8B, roughness of the liquid absorbing particles 17 does not appear in the surface of the recording medium P to thereby express a high gloss feeling.

Although this exemplary embodiment has been described in the case where the gloss of the recording medium P (the thickness of the hardenable solution layer 16A) is controlled by the operating person's twofold selection between the high gloss mode and the low gloss mode, the gloss of the recording medium P (the thickness of the hardenable solution layer 16A) may be controlled by threefold or more selection. The gloss of the recording medium P (the thickness of the hardenable solution layer 16A) may be controlled by another method than the operating person's input operation or may be controlled regardless of mode selection.

Incidentally, in the first, second and third exemplary embodiments, the second forming portion 19 may be formed to supply the liquid absorbing particles 17 to a region of the transfer body 12 where the hardenable solution layer 16A is not formed.

In the first, second and third exemplary embodiments, the second forming portion 19 need not be configured to supply the liquid absorbing particles 17 to the hardenable solution layer 16A by adhesive force of the hardenable solution layer 16A to the liquid absorbing particles 17. For example, the second forming portion 19 may be configured to supply the liquid absorbing particles 17 to the hardenable solution layer 16A by electrostatic power.

In the first, second and third exemplary embodiments, configuration may be made so that the thickness of the hardenable solution layer 16A formed by the first forming portion 218 or 318 is not controlled.

The invention is not limited to the first, second and third exemplary embodiments. Various modifications, changes and improvements may be made on the invention. For example, the modifications may be formed by combination of a plurality of exemplary embodiments.

The foregoing description of the exemplary embodiment of the present invention has been provided for the purpose of illustration and description. It is not intended to be exhaustive or to limit the invention to the precise forms disclosed. Obviously, many modifications and various will be apparent to practitioners skilled in the art. The embodiments were chosen and described in order to best explain the principles of the invention and its practical application, thereby enabling other skilled in the art to understand the invention for various embodiments and with the various modifications as are suited to the particular use contemplated. It is intended that the scope of the invention be defined by the following claims and their equivalents.

[Description of Reference Numerals and Signs]

10 . . . image forming apparatus
12 . . . transfer body (an example of a to-be-formed body)
15 . . . layer forming device
16 . . . hardenable solution
16A . . . hardenable solution layer
17 . . . liquid absorbing particle
17A . . . liquid absorbing particle layer
18 . . . first forming portion (an example of a forming portion)
19 . . . second forming portion (an example of a transplantation portion)
20 . . . image forming portion
23 . . . hardening device (an example of a transfer portion)
200 . . . image forming apparatus
215 . . . layer forming device
218 . . . first forming portion (an example of a forming portion)
300 . . . image forming apparatus
315 . . . layer forming device
318 . . . first forming portion (an example of a forming portion)
P recording medium (an example of a to-be-transferred body)

What is claimed is:

1. A layer forming device comprising:

a first forming portion that supplies a hardenable solution capable of being hardened in response to a stimulus to a surface of a to-be-formed body to form a layer of the hardenable solution, the first forming portion being a liquid discharge head which discharges the hardenable liquid solution through nozzles; and a second forming portion that forms a layer of liquid absorbing particles by supplying the liquid absorbing particles to a surface of the layer of the hardenable solution formed by the first forming portion so that the liquid absorbing particles absorb liquid drops supplied to the surface of the layer of the hardenable solution, wherein the second forming portion brings the liquid absorbing particles into contact with the surface of the layer of the hardenable solution and supplies the liquid absorbing particles to the surface of the layer of the hardenable solution to from the layer of the liquid absorbing particles.

2. An image forming apparatus comprising:

the layer forming device according to claim 1;

an image forming portion that forms an image by discharging liquid drops to be absorbed by the liquid absorbing particles onto the surface of the layer of the hardenable solution with the layer of the liquid absorbing particles formed by the second forming portion of the layer forming device; and a transfer portion that gives the stimulus to the layer of the hardenable solution with the image formed thereon by the image forming portion, that hardens the layer of the hardenable solution, and that transfers the layer of the hardenable solution onto a to-be-transferred body.

3. The image forming apparatus according to claim 2, wherein the first forming portion is configured to change the thickness of the layer of the hardenable solution formed on a surface of the to-be-formed body to a plurality of thicknesses.

* * * * *